US006951080B2

(12) United States Patent
Korman et al.

(10) Patent No.: US 6,951,080 B2
(45) Date of Patent: Oct. 4, 2005

(54) CULM BLOCKS

(75) Inventors: Benjamin Z. Korman, Cayucos, CA (US); John A. Ruskey, III, Goleta, CA (US); Doug C. Priest, Yolo, CA (US)

(73) Assignee: Oryzatech Inc., Yolo, CA (US)

( * ) Notice: Subject to any disclaimer, the term of this patent is extended or adjusted under 35 U.S.C. 154(b) by 0 days.

(21) Appl. No.: 10/143,142

(22) Filed: May 10, 2002

(65) Prior Publication Data

US 2003/0208982 A1 Nov. 13, 2003

(51) Int. Cl.[7] ..... E04H 1/00
(52) U.S. Cl. ..... 52/79.2; 52/600; 52/729.1
(58) Field of Search ..... 52/896, 561, 729.1, 52/289, 79.1, DIG. 9, 729.2, 79.4, 293.3, 223.7, 79.2, 600; 162/13, 182, 23; 100/3, 9

(56) References Cited

U.S. PATENT DOCUMENTS

| | | | | | |
|---|---|---|---|---|---|
| 225,065 | A | * | 3/1880 | Leeds | 52/600 |
| 1,604,097 | A | * | 10/1926 | Monroe | 52/432 |
| 1,633,702 | A | * | 6/1927 | Hewlett et al. | 52/289 |
| 4,058,580 | A | * | 11/1977 | Flanders | 264/113 |
| 4,154,030 | A | | 5/1979 | Huguet | 52/98 |
| 4,225,359 | A | | 9/1980 | Schneider | 106/93 |
| 4,248,343 | A | * | 2/1981 | Schaefer | 206/83.5 |
| 5,432,213 | A | | 7/1995 | Kim et al. | 524/41 |
| 5,519,985 | A | | 5/1996 | Dyck et al. | 53/527 |
| 5,656,129 | A | * | 8/1997 | Good et al. | 162/13 |
| 5,749,199 | A | * | 5/1998 | Allen | 52/729.1 |
| 5,749,954 | A | | 5/1998 | Law et al. | 106/282 |
| 5,893,309 | A | * | 4/1999 | Ast | 83/95 |
| 5,937,588 | A | * | 8/1999 | Gard | 52/79.1 |
| 6,041,566 | A | * | 3/2000 | Allen | 52/729.1 |
| 6,061,986 | A | * | 5/2000 | Canada | 52/561 |
| 6,272,805 | B1 | | 8/2001 | Ritter et al. | 52/309.11 |

OTHER PUBLICATIONS

Platts, Bob, P.E., "A Threat to Strawbale Housing", *The Last Straw*, Issue #22 (1998), http://www.stawhomes.com/backissues/articles/22_07.html, Mar. 11, 2002.
"House of Straw, Straw Bale Construction Comes of Age", U.S. Dept. of Energy, Energy Efficiency and Renewable Energy (1995), http://www.eren.doe.gov/buildings/documents/strawbale.html, Mar. 11, 2002.
"R–Value of Straw Bales Lower Than Previously Reported", *Environmental Building News*, vol. 7, No. 9 (1998), http://www.buildinggreen.com/news/r–value.html, Mar. 11, 2002.
Lassuy, Elizabeth, "Straw–Bale Dome Report", *The Art of Natural Buildings: Design, Construction, Technology*, http://www.networkearth.org/naturalbuilding/sbdome.html, Mar. 13, 2002.
"Straw: The Next Great Building Material?", *Environmental Building News*, vol. 4, No. 3 (1995), http://www.buildinggreen.com/features/straw/straw.html, Mar. 11, 2002.
"Wise Guys Write Book: Build It With Bales, Version Two", *The Last Straw*, Issue #19 (1997), http://www.strawhomes.com/backissues/articles/19_03.html, Mar. 11, 2002.

* cited by examiner

*Primary Examiner*—Leslie A. Braun
*Assistant Examiner*—Tan Le

(74) *Attorney, Agent, or Firm*—Dobrusin & Thennisch PC

(57) ABSTRACT

A culm block and a method of manufacture are disclosed. The culm block comprises a plurality of straw stalks that are "vertically aligned", i.e., perpendicular to the ground when the block is laid flat. The straw is treated with a moisture inhibitor and/or a binder. Throughholes, which may have tubes associated therewith, are formed into the top and bottom walls of the culm block. A lath or external strapping sleeve is wrapped about the front, rear, and side walls of the block for added structural support. The method of manufacture may include sorting the stalks according to length, checking the stalks for moisture content, and drying the stalks depending upon their moisture content prior to compression and formation.

33 Claims, 4 Drawing Sheets

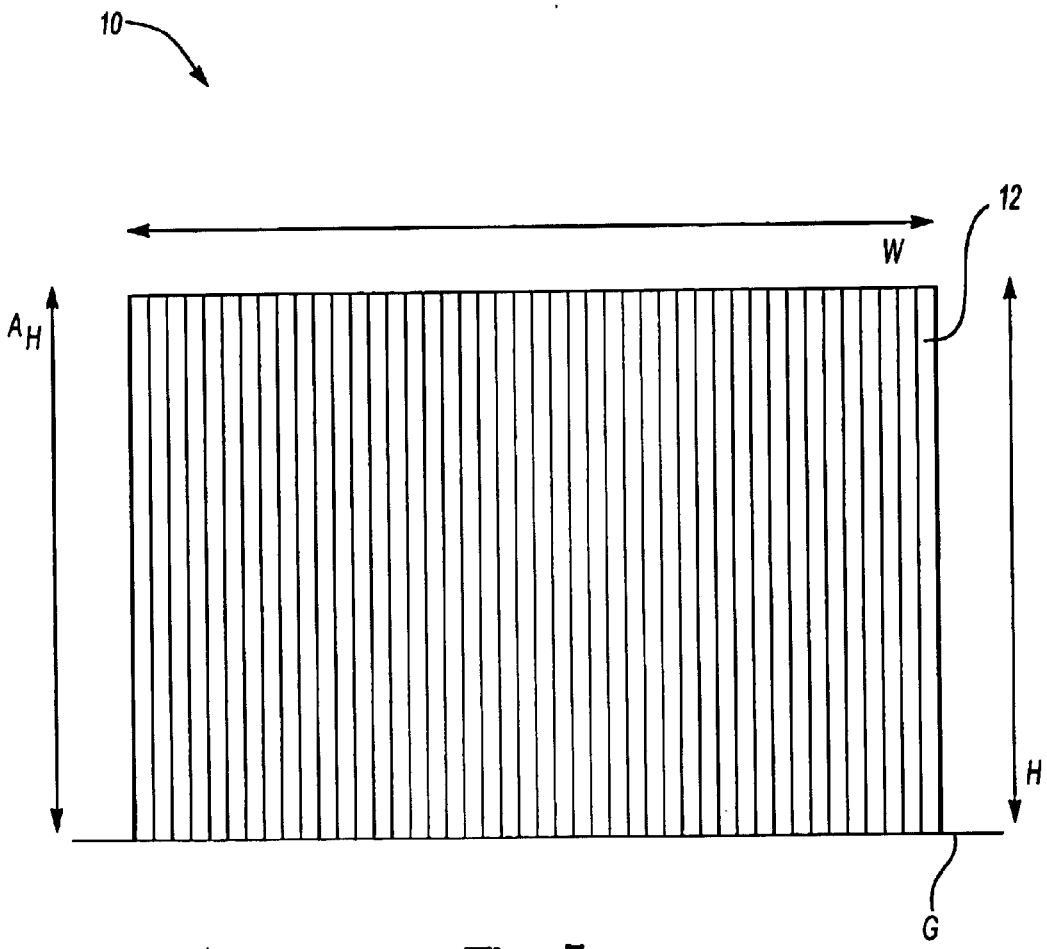
Fig-3
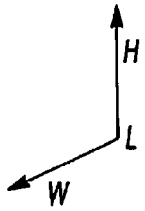

CULM BLOCKS

BACKGROUND OF THE INVENTION

The field of the present invention relates to building materials and particularly to "green" building blocks made from culm such as residual rice straw, a by-product of the rice growing industry.

Providing affordable housing while decreasing air pollution is an ideal worth fighting for. Housing is typically considered by most not to be affordable due, in part, to the high cost of the building materials. Conventional building materials, such as lumber, are costly because they are becoming more and more scarce as the demand for more and more housing increases to meet the needs of the world's burgeoning population. In addition, when the trees are cut down to make the lumber to build the house, the result is an adverse effect on our air quality as these natural resources are no longer able to turn carbon dioxide into oxygen.

In an effort to find alternative building materials, people have been turning to recycled goods and/or the by-products of an industry. One such source has been culm, commonly referred to as straw, which is what is left over when grains, such as wheat, rice, barley, oats, and rye, are harvested. Straw is a viable building material because it is plentiful and inexpensive. Buildings built with straw bales have well-insulated walls, simple construction, and low costs. Moreover, in many areas, straw is still burned in fields, producing significant air pollution. For example, in California more than one million tons of rice straw were burned each fall in the early 1990's, generating an estimated 56,000 tons of carbon monoxide annually, which is approximately twice that produced from all of the state's power plants. By converting an agricultural by-product into a valued building material, another benefit to the community is therefore a reduction in air pollution.

A number of drawbacks exist to the use of straw as a building material. Straw does not have the same structural integrity as wood, cement, or other conventional building materials. As a consequence, straw does not have the load bearing capacity that so many architects, engineers, and contractors require. Straw is also highly susceptible to moisture and can and will rot if there is too much exposure to moisture over time. Moreover, straw bales are of an inconsistent quality. They are also not sized to building industry standards.

FIG. 5 is illustrative of some of these points. Shown there are two differently sized conventional straw bales, namely, a 3-tie straw bale on the left and a 2-tie straw bale on the right. The denomination of "3-tie" or "2-tie" is due to the number of ties T being wrapped about the straw stalks S, as seen in FIG. 5. The larger 3-tie bale is typically 32" to 47" long by 23" to 24" wide by 14" to 17" high. The dimensions of a 2-tie bale are similarly varied and are typically in the range of 35" to 40" long by 18" wide by 14" high. A conventional concrete or cinder building block, however, is typically 24" long by 12" wide by 12" high. The weight of a 3-tie bal can be anywhere between 75 to 100 lbs., whereas a 2-tie bale is typically 50 lbs. OSHA product weight requirements, however, require less than 50 lbs. per block, with 40 lbs. typically being an acceptable weight that can be handled by one person.

FIG. 5 illustrates that the straw stalks S of a conventional straw bale appear to be aligned parallel to a single axis of alignment, $A_w$. The appearance of alignment occurs because of the cut, rake, and bale process of making the bale. There are no machines or modifications of machines that intentionally align the straw to make specific straw-aligned bales. The general alignment $A_w$ of the straw S can be described as "horizontally aligned", i.e., horizontal or parallel to the ground G when the bale is laid flat. The general alignment $A_w$ can also be described as running parallel to the width W axis and perpendicular to the length L and height H axes or, alternatively, parallel to the plane defined by the top or bottom walls (the intersection of the L and W axes).

It is the inventors' understanding that those skilled in the art prefer "horizontal alignment" to increase the load bearing capacity of each bale. Gleaned from compression tests of individual bales, the prior art teaches that flat bales can carry far more load than bales stacked on edge. Flat bales failed at an average load of 10,000 lb/ft$^2$ (48,800 kg/m2); on edge, bales failed at an average of 2,770 lb/ft$^2$ (13,500 kg/m$^2$). To further increase the load bearing capacity of the bale other than laying it flat, the prior art also teaches the use of threaded rods that may be inserted through each bale or framed around each bale and then bolted through a wide top plate and tightened down after the roof is installed. Pre-compressing the walls in this manner minimizes further settling after the roof is installed.

FIG. 5 also illustrates how conventional prior art straw bales do not have a smooth cut surface and the corners are rounded, i.e., the edges are not crisp and the corners are not square. What FIG. 5 does not illustrate is the high level of susceptibility to moisture damage that straw has or the inconsistent and often poor quality of the traditional straw bale itself.

A "green" building material such as a culm or straw block that has an increased load bearing capacity over traditional straw bales, is of a consistent quality, is sized for building industry standards, and has an increased resistance to water damage is therefore desired.

SUMMARY OF THE INVENTION

Having recognized these conditions, the present invention is directed to a culm block comprising a plurality of straw stalks that are "vertically aligned", i.e., perpendicular to the ground when the block is laid flat. Vertically alignment, the inventors surprisingly discovered, advantageously provides for at least 25% greater load bearing capacity compared to conventional horizontally aligned bales. Vertical alignment also advantageously provides for increased insulating values, as well as a smooth cut surface. By vertically aligning the straw, the culm block of the present invention also advantageously has a consistent shape, with square corners and crisp edges.

Another related aspect of the invention is to provide a culm block that is properly sized for building industry standards.

The culm block may also be treated with a binder and a moisture inhibitor to further increase the block's quality, structural integrity, and resistance to moisture damage.

The culm block may optionally include a pair of through-holes drilled through the top and bottom walls. The holes may be used to tie the blocks to the foundation and thereby ultimately increase the shear integrity of the wall system.

In a similar manner, the culm block may include a lath or external strapping sleeve for added structural support. Prior to the addition of the lath, the culm block may be mill finished to further increase its quality and consistency.

Another aspect of the present invention is a method for forming the novel culm block that may include sorting the stalks according to length, checking the stalks for moisture content, and drying the stalks depending upon their moisture content prior to compression and formation. Other and further objects and advantages will appear hereinafter.

BRIEF DESCRIPTION OF THE DRAWINGS

FIG. 3 is a cross-sectional view taken along line 3—3 shown in FIG. 1;

DETAILED DESCRIPTION OF PREFERRED EMBODIMENTS

Preferred embodiments will now be described with reference to the drawings. For clarity of description, any element numeral in one figure will represent the same element if used in any other figure.

Figure 1:
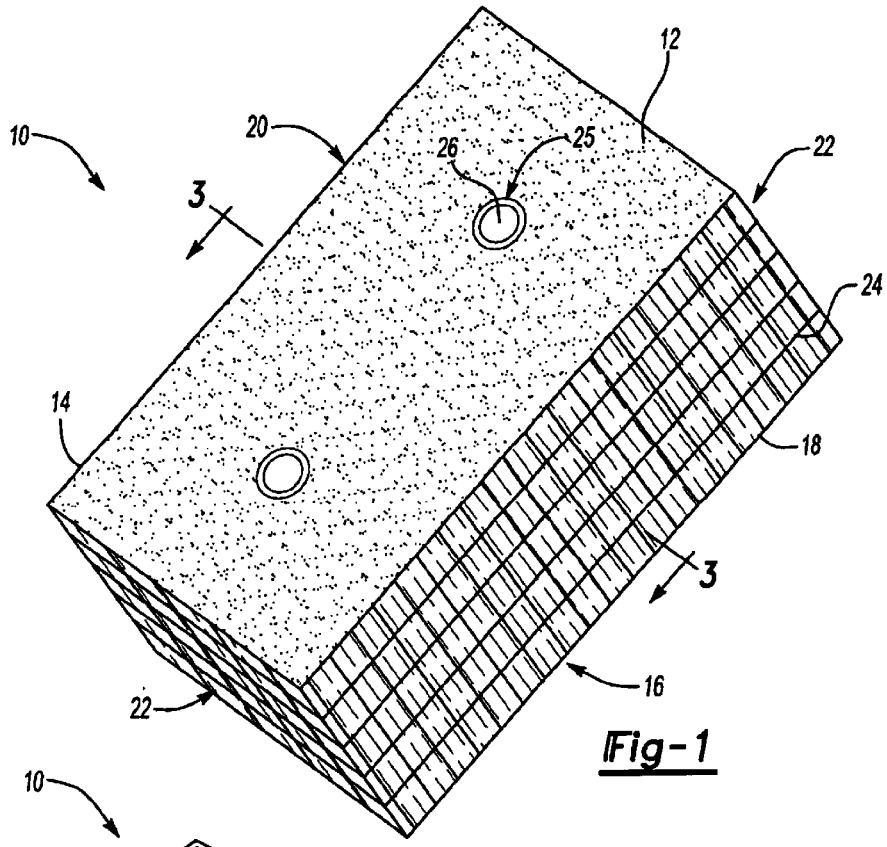
FIG. 1 is a perspective view of a culm block according to a preferred embodiment.
Figure 2:
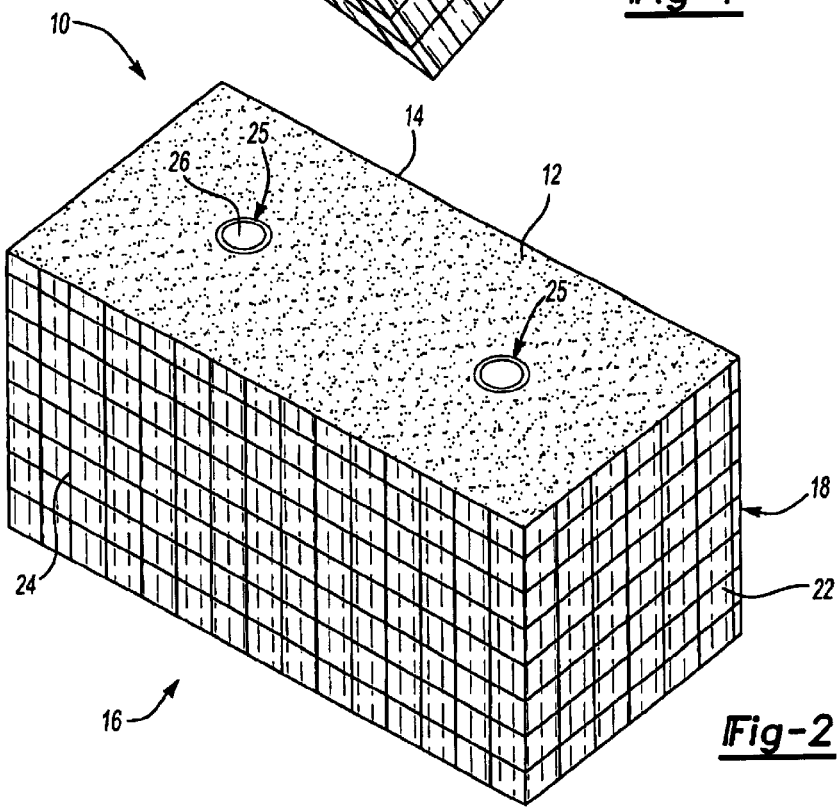
FIG. 2 is another perspective view of the culm block shown in FIG. 1.

FIGS. 1–3 illustrate a culm block 10 comprised of a plurality of adjacent stalks 12 substantially aligned parallel to one another and formed to define the building block 10. The stalks 12 may be wheat, rice, barley, oats, or rye straw. Rice straw is preferred due to its extremely high silica content and therefore inherent fire retardant properties. Moreover, rice straw is typically weed and pest free.

The block 10 has a top wall 14 and an opposing bottom wall 16, a front wall 18 and an opposing rear wall 20, and first and second opposed sidewalls 22. A lath 24 is seen disposed about the front and rear walls 18, 20 and sidewalls 22. The lath 24 may be described as a sleeve that is wrapped about the block 10.

The lath 24 provides increased structural support to the block 10. Such a feature is particularly advantageous when one considers that a traditional bale typically only has two or three ties usually made of twine for support, such as the ties T illustrated in FIG. 5. Because of such a lack of support, conventional bales can easily fall apart or bulge under their own weight. The lath or wire mesh banding 24 around block 10 girdles it and advantageously provides resistance to the straw stalks 12 from bulging. In addition, the lath 24 also provides an additional option for an anchoring system. In particular, the lath 24 acts as stucco wire and will make the construction process with the block 10 faster than conventional bales. Conventional bales require the stapling of stucco wire on the side of the straw bale wall in order to provide an adequate structural matrix for the stucco. This process is eliminated with the novel block 10.

The lath 24 may be comprised of completely recycled material such as recycled steel or plastic. If steel is used, it is preferably galvanized and more preferably galvanized and coated.

Turning to FIGS. 1 and 2, the top wall 14 and bottom wall 16 define a pair of holes 25 therethrough. Tubing 26, which may be made from recycled plastic, may be inserted into each hole 25. The holes 25, either with or without tubing 26, may be included in block 10 to offer an optional alignment and anchoring system. If employed, the holes 25 are preferably 2½" in diameter. Structural steel reinforcing may be inserted through each hole 25 and set with a concrete grout, for example. The pre-drilled holes 25, when filled with concrete and steel, help to tie the blocks to the foundation, ultimately increasing the shear integrity of the wall system.

FIGS. 1 and 2 illustrate a block 10 that is sized to a building industry standard, namely, 24" long by 12" wide by 12" high. Accordingly, the block 10 illustrated in FIGS. 1 and 2 is rectangular in shape. Other dimensions may also be employed as long as they are standardized building sizes. Unlike traditional bales that are odd-sized, such as a 3-tie bale that may be 40" long by 22" wide by 16" high, the block 10 is a size that a builder can utilize consistent with existing building techniques developed for concrete blocks. Consequently, block 10 is easily adapted to current construction techniques; it easily integrates with traditional 4' by 8' construction modules; and it requires less space in the floor plan when compared to the larger footprint of a traditional straw bale wall.

As shown in FIGS. 1 and 2, the block 10 preferably weighs under 40 lbs. With this light weight, one person can handle the block 10. This weight is also within the OSHA product weight requirements, unlike traditional bales that may weigh up to 75 to 100 lbs., which weight requires two or more persons for moving and constructing.

As best seen in FIG. 3, the stalks 12 of the culm block 10 are "vertically aligned", i.e., they are perpendicular to the ground G when the block 10 is laid flat. The axis of alignment $A_H$ of the straws 12 is therefore preferably orthogonal to the plane defined by the top and bottom walls 14, 16 (the intersection of the L and W axes). As seen in FIG. 3, the axis of alignment AH runs orthogonal to the width W and length L axes and parallel to the height H axis or, alternatively, orthogonal to the plane defined by the ground G.

Contrary to the teachings of the prior art, vertically alignment provides for at least 25% greater load bearing capacity compared to conventional non-aligned or potentially "horizontally aligned" bales. Vertical alignment also advantageously provides for increased insulating values, possibly R-28 or higher, because horizontally placed straw of traditional bales acts like a wick, thus increasing the conductance (U-value) of the material and undesirably allowing for greater thermal transmission. Vertical alignment also provides for a smooth cut surface. By vertically aligning the stalks 12, the culm block 10 of the present invention has a consistent shape, with square corners and crisp edges. This makes the construction of buildings much more efficient when compared to traditional rounded corner straw bales.

Figure 4:
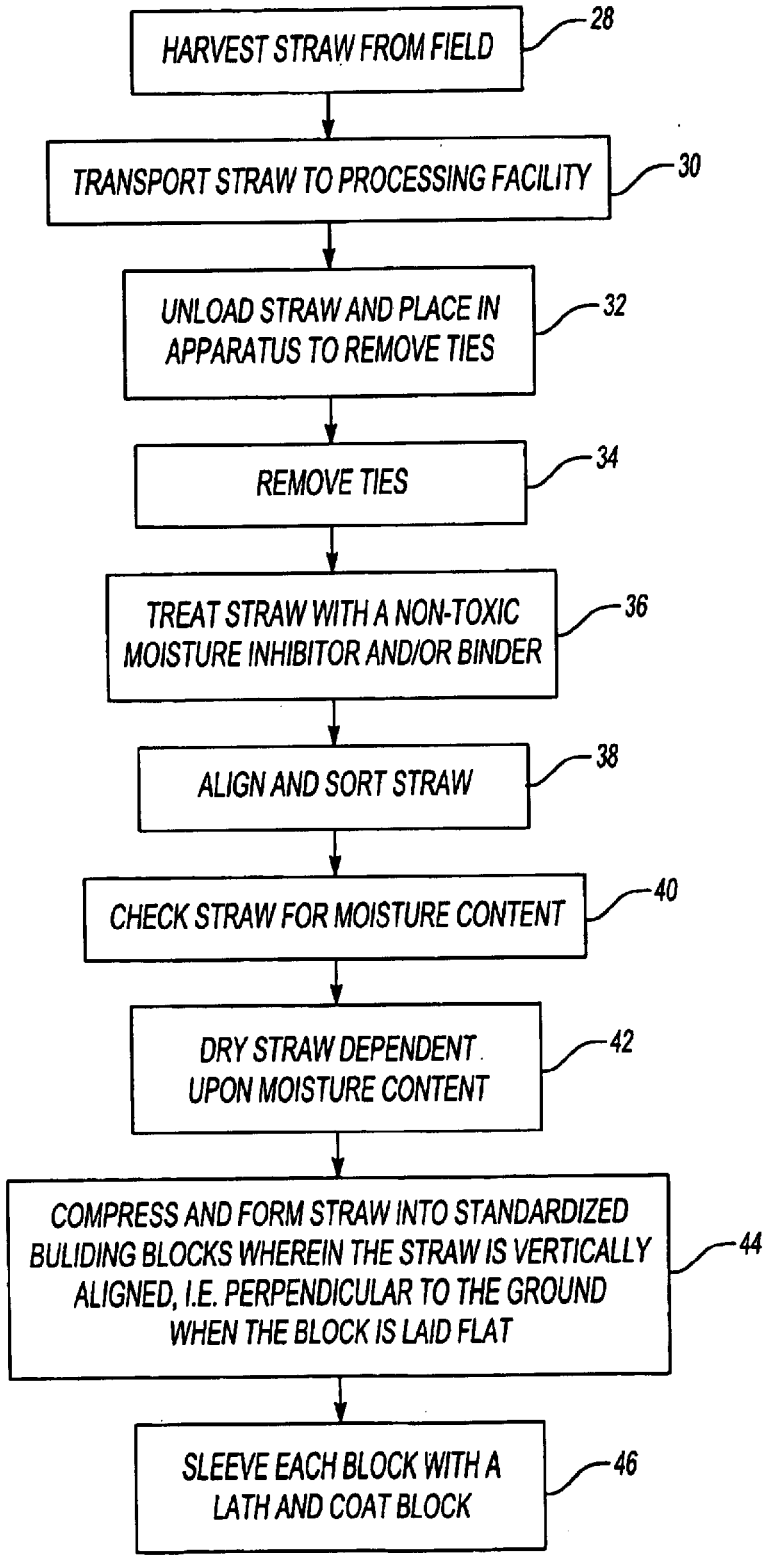
FIG. 4 is a flow chart illustrating a preferred method of manufacturing the culm block shown in FIG. 1.
Figure 5:
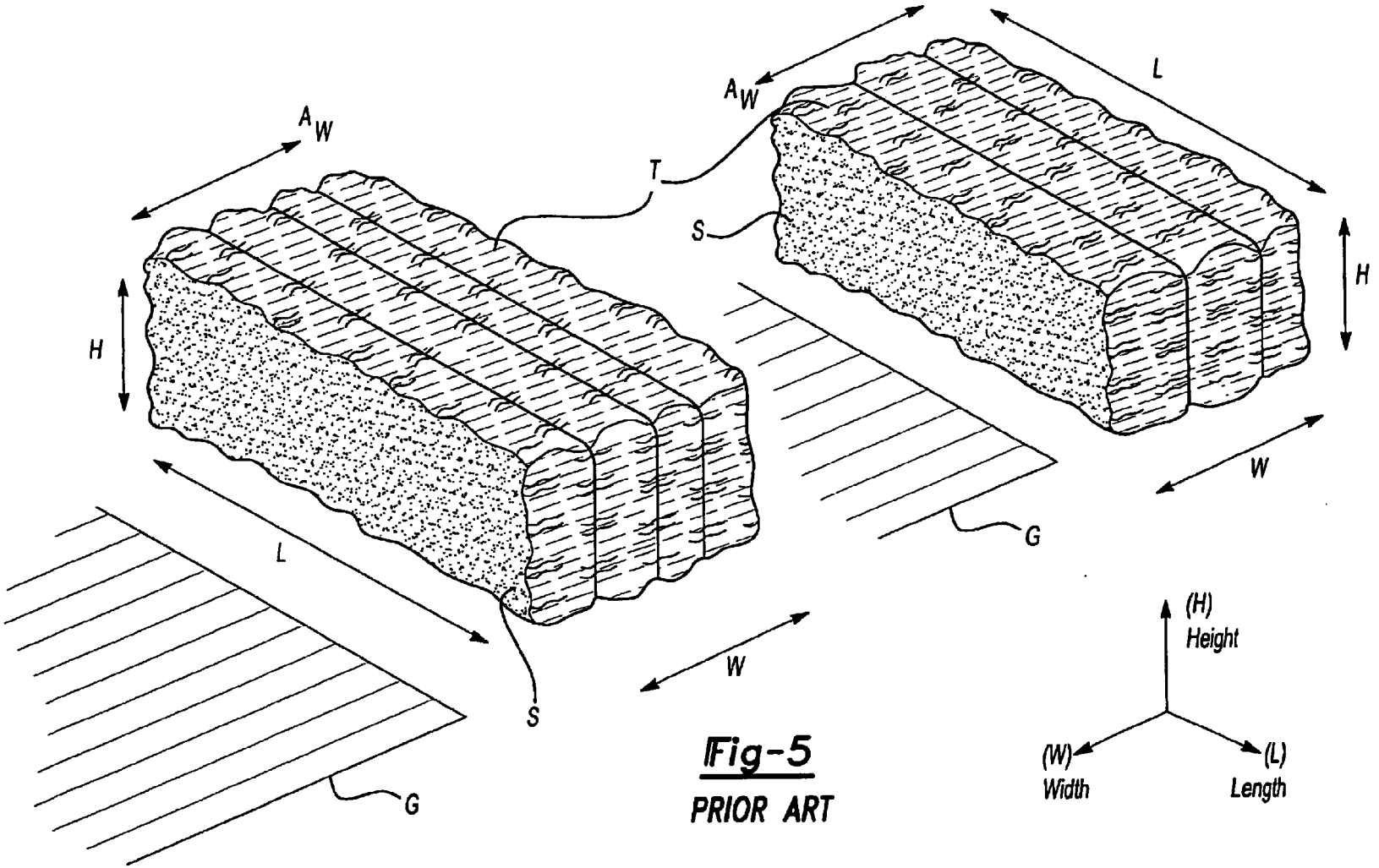
Fig-5 PRIOR ART
FIG. 5 illustrates the prior art.

Turning to FIG. 4, a method of forming the novel block illustrated in FIGS. 1–3 is disclosed. As shown there, the first step is "Harvest straw from field" at step 28. After harvesting, the straw then needs to be transported to the processing facility as shown at step 30. Once at the processing facility, the straw is unloaded at step 32, preferably via a hydraulic squeeze lift, and then loaded into an apparatus to remove the ties T (as shown in FIG. 5). The apparatus is preferably a Hunterwood 3-tie de-stacker. Once loaded into the de-stacker, the straw is moved down a conveying system to a twine saw. When the twine hits the twine saw, the bale ties are removed at step 34. The next step, step 36, is entitled "Treat straw with a non-toxic moisture inhibitor and/or binder."

At step 36, a moisture inhibitor and/or a binder is disposed on or integrated into the straw 12. Step 36 ensures that the block 10, when delivered, has a consistent quality. Current bales, such as those illustrated in FIG. 5, have high fluctuations in sizes, typically up to five inches, and a wide range in moisture content, typically between 10 to 25%. High moisture is the weakness and largest concern for builders interested in integrating straw building materials into their work. Straw will not rot at a moisture content of 14% or less. For this reason, the block 10 preferably has a predetermined moisture content not to exceed 14%. To ensure this, a drier system is part of the manufacturing process, as illustrated in FIG. 4 at step 42.

The binder and moisture inhibitor are both preferably environmentally friendly and non-toxic. When treated with the binder, the structural integrity of the block 10 should be increased without decreasing the insulating properties of the block 10. In a similar manner, when the stalks 12 are treated with the moisture inhibitor, the block's resistance to moisture is increased without decreasing the insulating properties of the block 10. Accordingly, the binder may be selected from the group consisting of aluminum hydroxide, magnesium hydroxide, clay, kaolin, bitumen, and most preferably borax (a natural product composed of hydrated sodium borate, sometimes referred to as or including sodium borate decahydrate, sodium diborate, tincal, tincalconite, tincar, hydrated sodium boration, sodium tetraborate, rasorite, or Sporax®). The moisture inhibitor may be selected from the group consisting of paraffin wax, silica gel (a non-toxic, non-corrosive form of silicon dioxide synthesized from sodium silicate and sulfuric acid and processed into granular or beaded form), molecular sieve (a uniform network of crystalline pores and empty adsorption cavities derived from sodium, potassium or calcium crystalline hydrated aluminosilicates), activated clay (a layered structure of activated (bentonite) clay that is a naturally occurring, non-hazardous and salt-free substance), bitumen, and most preferably borax.

Referring again to FIG. 4, the next step in the process is step 38 entitled "Align and sort straw." Here, the stalks 12 are intentionally aligned substantially parallel and most preferably parallel to one another. The stalks 12 are also preferably sorted according to length, wherein stalks 12 of substantially identical length are grouped together. After the stalks 12 are aligned and sorted together and step 38, the moisture content of the stalks 12 is then checked at step 40. The stalks 12 are dried via a drier system dependent upon the moisture content at step 42. The stalks 12 are preferably dried to a moisture content not to exceed 14%, as straw will not rot at a moisture content of 14% or less.

After the stalks 12 are dried to the preferred moisture content of 14% or less, the stalks 12 are compressed and formed into standardized building blocks wherein the stalks 12 are vertically aligned or, stated otherwise, perpendicular to the ground when the block is laid flat, as shown in FIG. 4 at step 44 and, regarding the vertical alignment, as best seen in FIG. 3. For compressing and forming the stalks 12 into the block shape, the stalks 12 are preferably fed into a Hunter Wood fc8310 series forage compactor. Once compacted, the block 10 exits the compression chamber and is sleeved with a lath, preferably comprised of recyclable galvanized steel and coated at step 46. The block 10 then exits the conveyor, is palletized, stretch-wrapped, pallet bar coded, and ready for shipping or storage.

Prior to the addition of the lath, such as lath 24 illustrated in FIGS. 1 and 2, the culm block 10 may be mill finished to further increase its quality and consistency. Where the optional throughholes, such as holes 25 illustrated in FIGS. 1 and 2, are desired, the holes may be drilled before or after step 46, but are preferably drilled before step 46. Tubing 26 may also be inserted into each hole 25 at this time. The pre-drilled holes 25, when filled with concrete and steel, help to tie the blocks 10 to the foundation, ultimately increasing the shear integrity of the wall system.

Thus, while embodiments and applications of the novel culm block and method for making the culm block have been shown and described, it would be apparent to one skilled in the art that other modifications are possible without departing from the inventive concepts herein. The invention, therefore, is not to be restricted except in the spirit of the claims that follow.

What is claimed is:

1. A building block having a top substantially planar wall, a bottom substantially planar wall, first and second substantially planar end walls, a first substantially planar sidewall, and a second substantially planar sidewall comprising:

a plurality of adjacent stalks substantially all of which are substantially vertically aligned and extending substantially orthogonal between said bottom wall to said top wall and formed to define a block for building, the stalks having a predetermined moisture content; and a binder disposed on or integrated into the stalks for maintaining a shape of the block and securing the stalks together.

2. The building block of claim 1, further comprising a moisture inhibitor disposed on or integrated into the stalks for maintaining the moisture content.

3. The building block of claim 2 wherein the moisture inhibitor is borax.

4. The building block of claim 2 wherein the moisture inhibitor and the binder are non-toxic.

5. The building block of claim 1 wherein the block further includes a coating.

6. The building block of claim 1 further defining at least one through-hole extending between the top and bottom substantially planar walls.

7. The building block of claim 6 further comprising tubing inserted in the at least one through-hole.

8. The building block of claim 6 further comprising a structural steel reinforcement inserted in the at least one through-hole.

9. The building block of claim 7 further comprising concrete and steel located in the tubing.

10. The building block of claim 1 wherein the moisture content of the block is approximately 14% or less.

11. The building block of claim 1 wherein block is generally rectangular in shape.

12. The building block of claim 11 wherein the block is approximately 24" long by 12" wide by 12" high.

13. The building block of claim 12 wherein the block weighs approximately 40 lbs. or less.

14. The building block of claim 1 wherein the bottom wall is adapted for placement against a ground surface.

15. The building block of claim 1 wherein the stalks are rice straw stalks.

16. The building block of claim 15 wherein the rice straw stalks are compressed.

17. The building block of claim 16 wherein the rice straw stalks are of substantially the same length.

18. The building block of claim 1 further comprising a lath substantially wrapped about the block.

19. The building block of claim 18 wherein the lath comprises galvanized steel.

20. The building block of claim 1 further comprising girdling means wrapped about the sidewalls and end walls of the block for providing girdling of the block.

21. The building block of claim 20 wherein the girdling means comprises a lath.

22. The building block of claim 21 wherein the lath is treated with a coating.

23. The building block of claim 20 wherein the girdling means comprises a wire mesh.

24. The building block of claim 20 wherein the girdling means comprises recycled material.

25. The building block of claim 20 wherein the girdling means is treated with a coating.

26. The building block of claim 20 wherein the girdling means comprises steel.

27. The building block of claim 20 wherein the stalks are rice straw stalks.

28. The building block of claim 1 wherein the top and bottom walls are smooth cut and adjoin the sidewalls and end walls to form square corners.

29. The building block of claim 1 wherein the moisture content of the block is approximately 14% or less and includes a moisture inhibitor disposed on or integrated into the stalks for maintaining the moisture content of the block.

30. The building block of claim 29 further comprising a lath substantially wrapped about the sidewalls and end walls for providing girdling means.

31. The building block of claim 30 wherein the top and bottom substantially planar walls are smooth cut and adjoin the sidewalls and end walls to form square corners.

32. The building block of claim 31 wherein the stalks are compressed to form a building block approximately 24" long by 12" wide by 12" high and weighs approximately 40 lbs. or less.

33. The building block of claim 32 wherein the stalks are rice straw stalks.

* * * * *